US005379528A

United States Patent [19]

Oechsle

[11] Patent Number: 5,379,528

[45] Date of Patent: Jan. 10, 1995

[54] PAPER MAKING MACHINE DRYING SECTION STEAM PRESSURE PROFILE

[75] Inventor: Markus Oechsle, Bartholomae, Germany

[73] Assignee: J. M. Voith GmbH, Heidenheim, Germany

[21] Appl. No.: 164,412

[22] Filed: Dec. 9, 1993

[51] Int. Cl.[6] ..... F26B 3/00

[52] U.S. Cl. ..... 34/446; 34/116; 34/123; 34/568

[58] Field of Search ..... 34/113–124, 34/402, 414, 443, 444, 445, 446, 558, 559, 552, 568, 73, 449

[56] References Cited

U.S. PATENT DOCUMENTS 4,625,430 12/1986 Aula et al. ..... 34/116

5,291,666 3/1994 Babinsky et al. ..... 34/117

*Primary Examiner*—Denise L. Gromada

*Attorney, Agent, or Firm*—Ostrolenk, Faber, Gerb & Soffen

[57] ABSTRACT

A drying section of a paper making machine has a series of single tier drying groups, all with their respective felt belts arranged so that the drying cylinders are in contact with and dry one side of the web. The single tier groups are followed by one double tier drying group wherein the web passes such that the top side, then the bottom side, then the top side, then the bottom side, etc. of the web is in contact with successive drying cylinders arranged in two rows. Steam under pressure is supplied to all the drying cylinders. In the double tier group of drying cylinders, the steam pressure supplied to a first set of drying cylinders in sequence is higher than the steam pressure supplied to a second set of drying cylinders.

14 Claims, 2 Drawing Sheets 15
14
40
46
42
52
54
44
48
16
30
13
25
26
12
23
22
20
24
11
10

PAPER MAKING MACHINE DRYING SECTION STEAM PRESSURE PROFILE

BACKGROUND OF THE INVENTION

The present invention relates to the drying section of a paper making machine and particularly to the steam pressure profile of the drying cylinders of the drying section.

In a paper making machine, a web of paper is formed as a very wet pulp suspension, is drained of some water in a forming section, is pressed partially dry in a press section and is delivered to pass through a drying section. Paper making machine drying sections typically include a series of hollow, metal drying cylinders or dryers, which are fed pressurized steam to heat the peripheral surfaces of the cylinders. The web to be dried is led along a path that brings it into contact with the peripheral surface of each of the drying cylinders in sequence. The heat transferred to the web by each drying cylinder heats the web and enhances the evaporation of water from the wet web, ultimately bringing the web to a high percentage of dryness. For example, a web may enter the drying section as wet as only 45% dry and may leave the drying section as much as 92% to 98% dry. The amount of heat supplied to the paper web as it moves past each drying cylinder is a function of the temperature of the peripheral surface of the cylinder over which the web passes. The temperature is in turn a function of the pressure of the steam in the cylinder. A cylinder with higher pressure steam is hotter.

All of the drying cylinders in a drying section are fed with steam which may be from a common steam source. The pressures in different cylinders may not all be maintained at the same level, which means also that the cylinder temperatures vary. The steam pressure may be controlled by the manner in which steam is fed to the cylinders or by valving of the steam to the cylinders. As the web becomes progressively drier, different cylinder temperatures provide optimum drying of the web.

The invention is applicable to a particular configuration of a drying section. A drying section comprises a series of drying cylinders which are typically operated in a plurality of separate groups of the drying cylinders. The drying groups typically are either of the double tier or single tier variety.

In a double tier dryer group, the active heated drying cylinders are arrayed in two rows. The web is passed through the double tier group by one side of the web first contacting a drying cylinder in one row, and the other side of the web next contacting a drying cylinder in the other row, and one side of the web next contacting a drying cylinder in the first row, then the other side of the web contacting a drying cylinder in the second row, and so forth through the entire double tier drying group. In each case, the web wraps around drying cylinders, one after the other.

In each single tier drying group, in contrast, only one side of the web, e.g. the underside of the web, is in contact with each of the drying cylinders in the group. In order to desirably increase the angle of wrap of the web around each drying cylinder in the single tier drying group, there is a web guiding and reversing roll, typically in the form of a vacuum roll, between adjacent drying cylinders in the dryer group. That reversing roll is placed to cause the web to wrap around a significant portion of the circumference of the adjacent drying cylinders in the single tier group.

A web supporting, dryer felt belt or felt is provided for each single tier drying group. The felt supports one surface of the web and carries the web from drying cylinder to drying cylinder within the single tier dryer group. In a typical double tier drying group, the path of the web from a drying cylinder in one row to a drying cylinder in the other row is not felt supported.

Other known drying cylinder arrangements within a drying group are known.

A design that is a hybrid of at least one single tier drying group feeding the partially dried web to at least one double tier drying group was known in the early 1980's. Initially, such designs typically included a small quantity of the drying cylinders in the single tier group(s), followed by a significantly larger quantity of the drying cylinders in the double tier arrangement of one or more double tier groups. The few drying cylinders in the single tier groups mostly did not dry a web but rather heated the web for enabling the actual drying that took place in the double tier groups. As the hybrid arrangement evolved into the early 1990's, a larger portion of the drying cylinders were placed in the single tier groups and a smaller portion of the drying cylinders were placed in the double tier groups. A significant part of the drying, therefore, took place in the single tier drying groups, while the final drying took place in the double tier drying groups.

In some paper making machines, the dried web is subject to subsequent treatment, e.g. application of sizing in a size press or even coating on line after the drying section. The sizing applied is too sensitive to a high temperature dried web. Efforts have been made in the final part of the drying section, particularly in the double tier dryer groups of the hybrid arrangement, to control the temperature of the web at the end of the drying section for optimum web production. The present invention concerns a drying section heat control arrangement obtained through control of the delivery of steam pressure to at least certain drying cylinders.

SUMMARY OF THE INVENTION

It is the primary object of the present invention to produce an optimum quality paper web with good runability through the drying section of the paper making machine.

A further object of the invention is to provide the web at a desired, possibly reduced surface temperature to a subsequent web treatment on a paper making machine.

It is another object of the invention to optimize the passage of the web through a hybrid drying section comprising a series of drying cylinders in single tier arrangement followed by a series of dryers in a double tier arrangement.

Another object of the invention is to optimize web production in a hybrid type of drying section by reducing the steam pressure in at least some of the drying cylinders with reference to the steam pressure in others of drying cylinders.

The present invention concerns a hybrid drying section of at least one, and more usually a few, single tier drying groups followed by at least one double tier drying group at the end of the drying section, where at least a significant portion of both the heating of the web and the drying of the web are accomplished in the single tier drying group(s) and the final drying is accomplished in the double tier drying group.

For most effective web drying, in the double tier drying group and particularly the final double tier drying group in the drying section, a first or upstream plurality of drying cylinders are operated with a higher steam pressure and a second or downstream plurality of drying cylinders are operated with a lower steam pressure. The temperatures of the second plurality cylinders are reduced correspondingly to the reduction in steam pressure. Preferably, one final double tier drying group is divided between the upstream and downstream pluralities of drying cylinders. However, the invention is not restricted to use with only a single double tier drying group, as it is possible that the double tier arrangement may be in two drying groups. In each double tier drying group, the first or top row of drying cylinders is served by a first dryer felt, e.g. one loop that is closed above the first row of drying cylinders, and the second or bottom row of drying cylinders is served by another dryer felt, e.g. one loop that is closed below the second row of drying cylinders. This arrangement of felts is well known. If the double tier portion of the drying section includes more than one drying group, then each group would include its own pair of top and bottom felts. So far as the web is concerned, however, it would be going through a double tier portion of the drying section.

The invention concerns the final downstream plurality of drying cylinders of the double tier portion of the drying section operating at a lower steam pressure than the earlier upstream plurality of cylinders of the double tier portions, in order to reduce the surface temperature of the downstream plurality drying cylinders. That is done in order to permit the web to be further processed without being too hot.

Other objects and features of the invention will become apparent from the following description of a preferred embodiment of the invention considered in conjunction with the accompanying drawings.

DESCRIPTION OF A PREFERRED EMBODIMENT

Figure 1:
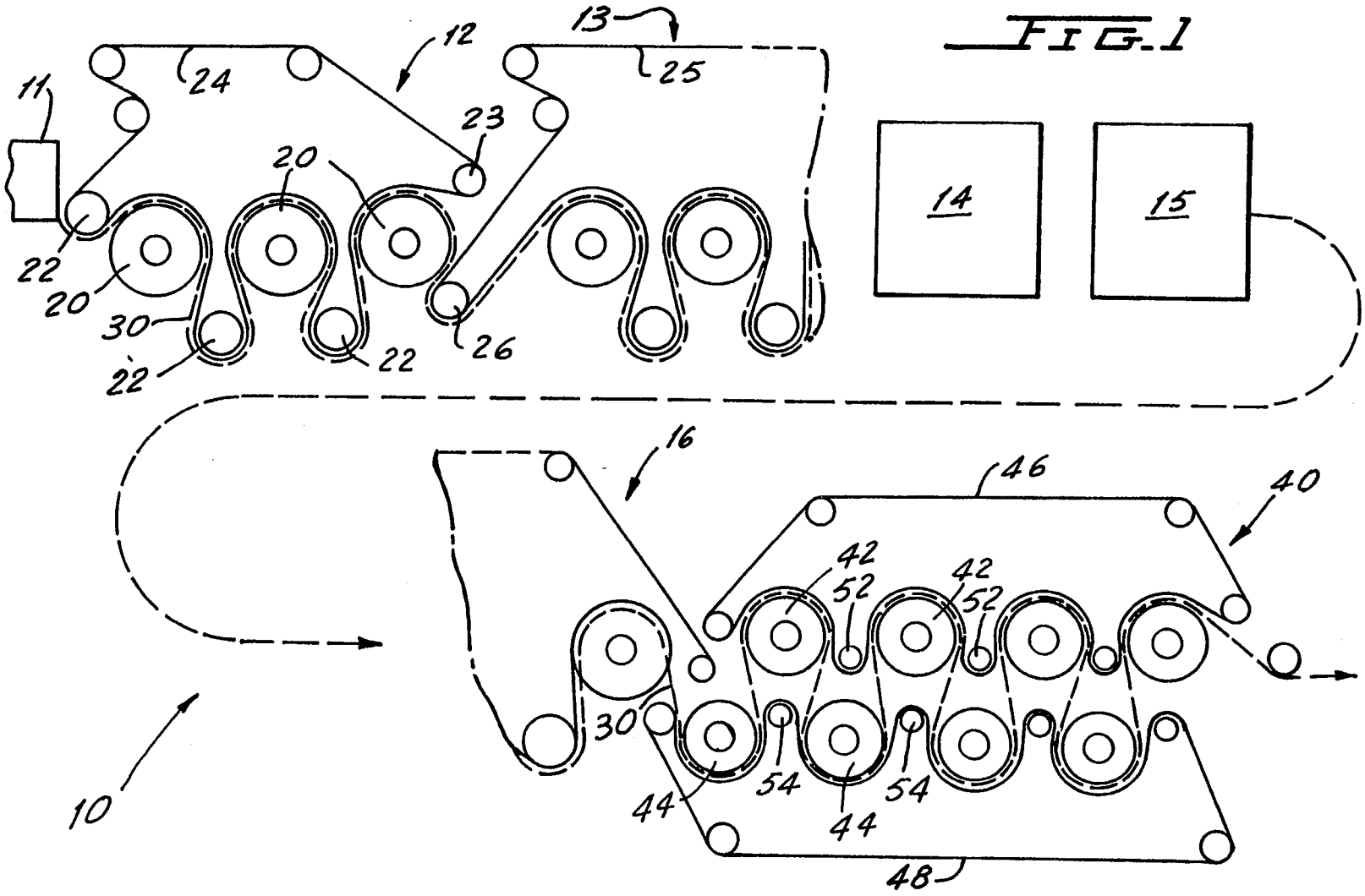
FIG. 1 is a schematic representation of a hybrid drying section of a paper making machine comprising a single tier drying group section followed by a double tier drying group section.

Referring to FIG. 1, a drying section 10 of a paper making machine receives a wet paper web from the press section 11. The web is passed through five successive single tier drying groups 12, 13, 14, 15 and 16 where the web is first heated and then dried as it passes through the drying groups. The single tier groups are arranged essentially in the same manner, so some of them are indicated by boxes.

Drying group 12 is typical. It includes a single row of drying cylinders 20 which alternate with vacuum transfer and web redirection rolls 22. An endless dryer felt belt 24 passes through the drying group 12 alternately over a vacuum roll 22, then over a drying cylinder 20, then over a vacuum roll 22, etc. At the end of the group, here following the final cylinder 20, the felt belt 24 returns around the felt roll 23 and the other felt rolls in the loop of belt 24 to the start of the group. The web 30 passes through the drying group, passing around the outside of the felt as it passes over the vacuum rolls 22 and then passing under the felt and in direct contact with the drying cylinders 20 as the web passes over the drying cylinders 20 through the entire drying group 12. The felt 24 holds the bottom side of the web securely against the drying cylinders which heat the web, so that after the web leaves the drying cylinder 20, the moisture will evaporate from the web.

In any of numerous known ways not described in detail, the web is transferred from drying group 12 to drying group 13 where the same process continues, and then to drying group 14 where the process continues, etc. In the illustrated drying section, the transfers between single tier drying groups are lick down transfers, with the web traveling around the final cylinder 20 in a group 12 transferring to the felt 25 of the next group 13 at the initial vacuum roll 26 of the next group 13.

In the illustrated embodiment, in the single tier groups 12–16, there are a total of 22 drying cylinders. At the end of the drying section, there is one double tier drying group 40 comprised of a first row of drying cylinders 42 which are above in the group and a second row of drying cylinders 44 which are below the first row. The web 30 passes first with its top side in contact with the first lower row drying cylinder 44 and next passes with its bottom side in contact with the first upper row drying cylinder 42, then back down to a lower row drying cylinder 44 and back up to an upper row drying cylinder 42, continuing through the double tier drying group. The double tier drying group is served by two felts, 46 for the top row and 48 for the bottom row of drying cylinders. The top row felt 46 is guided between adjacent drying cylinders 42 over respective upper felt transfer rolls 52, and the bottom row felt 48 is guided between adjacent drying cylinders 44 over respective lower felt transfer rolls 54. At both the upper and lower row drying cylinders 42 and 44, the web is held against the surface of each drying cylinder by the respective felt belt.

Each drying cylinder in all of the groups may be supplied with steam under pressure from a common steam source 60. Valving to the cylinders and the sequence of feeding steam to certain cylinders determines the steam pressures within the cylinders and the cylinder surface temperatures.

Figure 2:
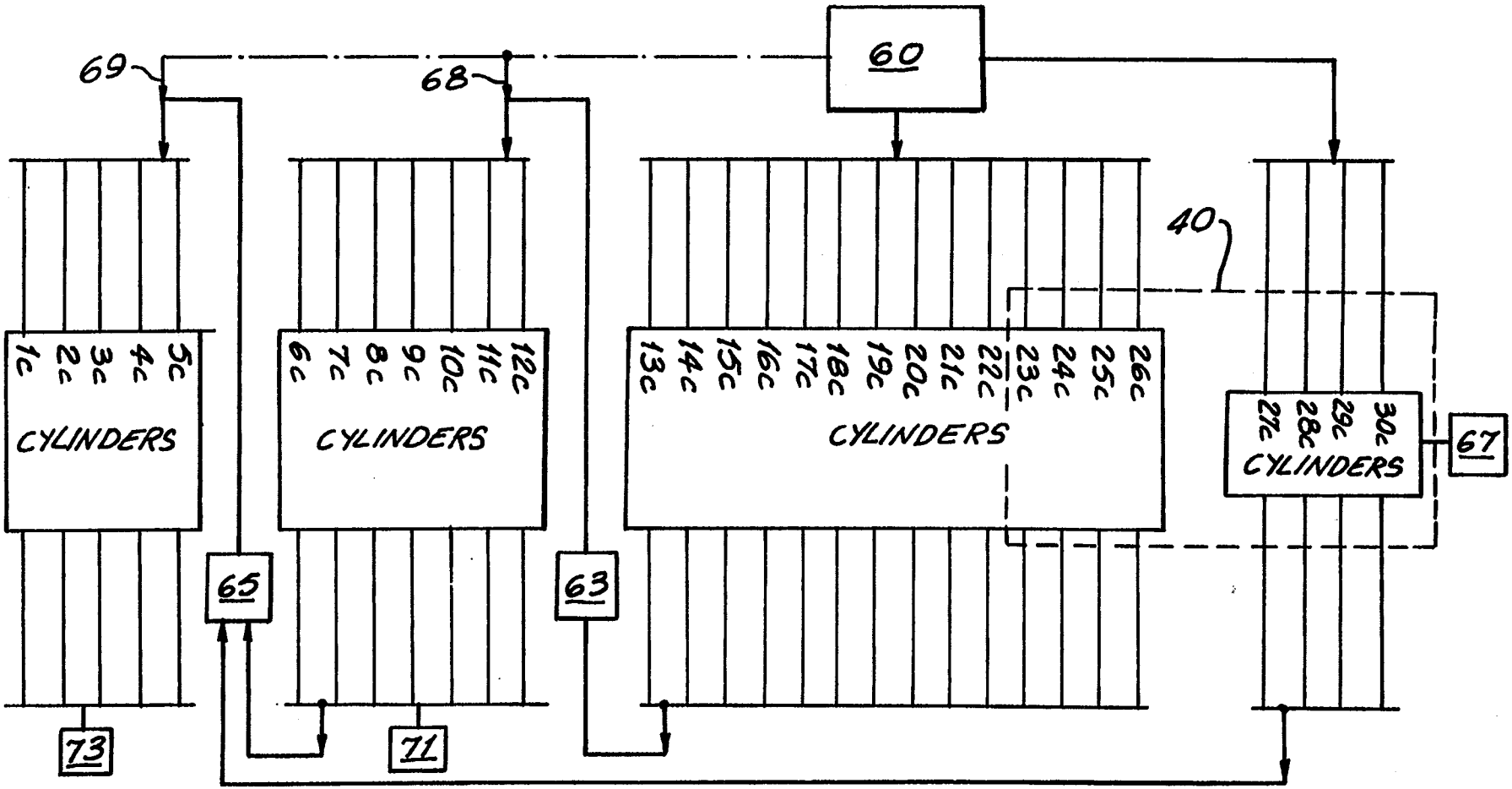
FIG. 2 is a schematic diagram showing the steam pressure delivery system of the invention.

The illustrated embodiment has a total of 30 same size drying cylinders. The first 22 cylinders, labeled 1*c* to 22*c* in FIG. 2, are all in five single tier groups 12–16. The last eight, labeled 23*c* to 30*c*, are in one double tier group.

As shown in FIG. 2, there is a common source or supply 60 of steam. Steam is supplied in a cascading arrangement supply in the example shown. The drying cylinders are divided into four steam groups, which do not correspond to the drying groups defined by the felt belts. The first steam group includes cylinders 1*c* to 5*c*, the second steam group includes cylinders 6*c* to 12*c*, the third includes cylinders 13*c* to 26*c* and the fourth includes cylinders 27*c* to 30*c*. Fresh steam from source 60 is first supplied to all of cylinders 13*c* to 26*c* in the third steam group at the highest pressure level. This third steam group of cylinders includes cylinders in single tier drying groups 14, 15 and 16 and the first four cylinder 23–26 in the double tier drying group 40. The steam and condensate move out of the third steam group of drying cylinders 13*c* to 26*c* to a common condensate separator 63, and the steam is transferred next to the second steam group of the drying cylinders 6c to 12c. The second steam group cylinders 6c to 12c are partly in both of single tier drying groups 13 and 14. If required, fresh steam may additionally be supplied to cylinders 6c to 12c through a feed line and valve 68. To assure that the steam pressure in the second steam group bears the desired relationship to the steam pressure in the third steam group, a vacuum source 71 may be connected to dryers 6c to 12c.

Again, the steam and condensate are drawn out of drying cylinders 6c to 12c, condensate is again removed by condensate separator 65 and the steam is finally delivered to first steam group drying cylinders 1c to 5c, but in reverse sequence, so that each of dryers 1c to 5c in that sequence has gradually higher steam pressure, which is controlled by regulating valves, not shown. Again, if fresh steam is required, it is supplied through a feed line and valve 69. To assure that the steam pressure in the first steam group bears a desired relationship to the steam pressure in the second and/or third steam groups, a vacuum source 73 may be connected to dryers 1c to 5c.

The last four dryers 26c to 30c form the fourth steam group and are supplied with steam separately from the steam source 60. A reduced pressure is drawn in those dryers by vacuum means 67 to lower the steam temperature in them to about 70° C., for example. For that purpose, the steam plus condensate outlets from dyers 27c to 30c are connected to the condensate separator 65 by line 66. The reduced pressure in dryers 26c to 30c causes the temperature of the web to be reduced from its highest temperature at dryer 26.

The particular temperatures and steam pressures in the dryers are selected for a particular paper grade and machine speed, plus other factors, so that specific numerical parameters cannot be given for every situation. What is significant is that the final dryers in the double tier drying group which are in the fourth steam group are at their own, likely different, pressures and temperatures. Preferably, the pressure and temperature in the fourth steam group cylinders is lower than that for the third steam group cylinders.

In one practical embodiment of the invention, the steam pressure in the first steam group dryers 1c to 5c is in the range of −7.0 to 20 psig; in the second steam pump dryers 6c to 12c is in the range of −1.5 to 55 psig; in the third steam group dryers 13c to 26c is in the range of 3–75 psig; and in the fourth steam group dryers 27c to 30c, in the range of −7.0 to 68 psig. The dryers in the fourth steam group, including only the final four dryers of the final double tier group, are to be at a lower pressure than the dryers in the third steam group and also the dryers in the second steam group. The pressure ranges stated above partially overlap. But the pressures in a particular application are selected so that they do not overlap. In the above practical embodiment, there is a steam pressure differential between the dryers of the first and second steam groups of 5–35 psig; between the second and third steam groups of 4.5–20 psig; and between the third and fourth steam groups of 0–7 psig, but preferably a positive difference in the last case. The particular pressure levels and pressure differentials are not required and are exemplary. The concept is the different pressure levels, especially between the third and fourth steam groups, and not their particular pressure numbers.

The total number of drying cylinders as well as the proportion of the drying cylinders in the single tier and double tier groups can vary with different applications, without varying from the concept of the invention. In the illustrated drying section 10, there are five single tier drying groups 12–16, with a total of 22 drying cylinders 1c to 22, followed by one double tier group 40 with eight cylinders 23c to 30c, wherein the upstream four cylinders 23c to 26c in the double tier group are at higher pressure and the downstream four cylinders 27c to 30c are at lower pressure. Following the double tier group 40, the web travels in known manner for subsequent treatment, e.g. to a size press, a coater, a calender or a winder.

Without departing from the invention, the arrangement does not require that all the dryers in the single tier group receive steam from the same source or under the same steam pressure or that the steam pressure within the dryers in the double tier group all be at the same level. But the final dryers of the double tier group in this hybrid arrangement are usually at a lower pressure level than the early dryers in that double tier group for accomplishing the objectives of the present invention.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A web drying section for a paper making machine, comprising:

a plurality of hollow, steam receiving drying cylinders arranged along a pathway of a paper web to be dried;

means associated with the drying cylinders for guiding the web to pass along a web pathway past the drying cylinders, with the web partially wrapping each of the drying cylinders in sequence along the path of the web;

the drying cylinders being arranged into a first and a second set; the first set of drying cylinders being in a single tier drying section array, wherein all the first set drying cylinders and the respective guiding means for the web at each cylinder are so arrayed that only one side of the web wraps around each of the drying cylinders in the first set thereof;

the second set drying cylinders are located along the path of the web after the first set drying cylinders, the second set of drying cylinders defining the end of the path of the web through the drying section; the second set drying cylinders being arrayed in two rows and the path of the web through the second set drying cylinders is directed so that a first side of the web is in contact with a first one of the second set drying cylinders in the first row thereof, then the opposite, second side of the web is in contact with a first one of the second set drying cylinders in the second row, then the first side of the web is in contact with a second one of the second set of drying cylinders in the first row, then the second side of the web is in contact with the second one of the second set of drying cylinders in the second row, and so forth through the second set of drying cylinders in two rows;

first steam supply means for supplying steam to the first set of drying cylinders under pressure for heating the first set drying cylinders;

second steam supply means for supplying steam at a first pressure level to a first group of the second set of drying cylinders, wherein the first group comprises a series of the second set drying cylinders in sequence along the path of the web, including at least one drying cylinder in the first row and the next successive drying cylinder in the second row;

third steam supply means for supplying steam to a second group of the second set of drying cylinders, which follows after the first group of cylinders in the second set in sequence along the path of the web through the second set, wherein the second group of drying cylinders in the second set comprises at least one drying cylinder in the first row and the next successive drying cylinder in the second row, and wherein the third steam supply means causes the steam pressure in the second group of the second set of cylinders to be at a lower pressure than the steam pressure in the first group of the second set of cylinders.

2. The drying section of claim 1, wherein the second and third steam supply means are adjusted so that the temperature of the first group of the second set of drying cylinders against the web is higher than the temperature of the second group of the second set of drying cylinders against the web.

3. The drying section of claim 1, wherein the first group of the second set of drying cylinders includes at least four of the drying cylinders and the second group of the second set also comprises at least four of the drying cylinders which follow after the first group thereof in the second set along the web path.

4. The drying section of claim 1, wherein the second group of the second set of drying cylinders are the final drying cylinders in the drying section.

5. The drying section of claim 1, wherein the first steam pressure supply means supplies steam to the respective first set cylinders at a greater pressure than the steam pressure supplied by the third steam supply means to the second group of the second set of cylinders.

6. The drying section of claim 1, wherein there is a greater number of drying cylinders in the first set thereof than in the second set thereof.

7. The drying section of claim 6, wherein the first set of drying cylinders are divided into a plurality of single tier drying groups; a respective endless loop dryer section felt belt being provided for each drying group of the first set of dryer cylinders; the respective felt belt passing alternately over one of the drying cylinders and the web guide means for the web at the respective drying cylinder.

8. The drying section of claim 7, wherein each of the felt belts of each of the drying groups of the first set is so trained over the respective drying cylinders that the felt belt holds the first side of the web in contact with each of the dryer cylinders of the first set as the web and the felt over the web wrap around each of the dryer cylinders.

9. The dryer section of claim 8, wherein the guide means comprise a respective vacuum roll disposed between each pair of the first set of drying cylinders in the respective drying groups, and the vacuum rolls being so placed between neighboring successive drying cylinders in sequence of the web path through the drying section that the vacuum rolls cause the web and the respective felt belt to partially wrap around each of the drying cylinders in the first set thereof.

10. The drying section of claim 8, wherein in the second set of drying cylinders, a respective first endless loop felt belt is trained around each of the first row of drying cylinders and supported by the respective guide means therefor to guide the web over the first row of cylinders with the first side of the web in contact with each of the first row of drying cylinders, and a respective second endless loop felt belt is trained around each of the second row of drying cylinders and supported by the respective guide means therefor to guide the web over the second row of cylinders with the second side of the web in contact with each of the second row of cylinders.

11. The drying section of claim 10, wherein the first set dryers and the guiding means are arranged so that the one side of the web in contact with the first drying cylinders is the bottom side of the web; the second set drying cylinders and the guiding means are arranged so that the first side of the web is the top side and the second side of the web is the bottom side.

12. The drying section of claim 9, wherein the first set dryers and the guiding means are arranged so that the one side of the web in contact with the first drying cylinders is the bottom side of the web; the second set drying cylinders and the guiding means are arranged so that the first side of the web is the top side and the second side of the web is the bottom side.

13. The drying section of claim 8, wherein the first set dryers and the guiding means are arranged so that the one side of the web in contact with the first drying cylinders is the bottom side of the web; the second set drying cylinders and the guiding means are arranged so that the first side of the web is the top side and the second side of the web is the bottom side.

14. The drying section of claim 1, wherein the first set dryers and the guiding means are arranged so that the one side of the web in contact with the first drying cylinders is the bottom side of the web; the second set drying cylinders and the guiding means are arranged so that the first side of the web is the top side and the second side of the web is the bottom side.

* * * * *